US011434117B2

(12) United States Patent
Knight, III

(10) Patent No.: US 11,434,117 B2
(45) Date of Patent: Sep. 6, 2022

(54) LIFTING AND SUPPORT APPARATUS

(71) Applicant: Stephen J. Knight, III, Littleton, CO (US)

(72) Inventor: Stephen J. Knight, III, Littleton, CO (US)

( * ) Notice: Subject to any disclaimer, the term of this patent is extended or adjusted under 35 U.S.C. 154(b) by 0 days.

(21) Appl. No.: 17/570,429

(22) Filed: Jan. 7, 2022

(65) Prior Publication Data

US 2022/0219957 A1 Jul. 14, 2022

Related U.S. Application Data

(60) Provisional application No. 63/135,971, filed on Jan. 11, 2021.

(51) Int. Cl.
*B66F 7/06* (2006.01)
*B66F 3/22* (2006.01)

(52) U.S. Cl.
CPC ..... *B66F 7/0666* (2013.01); *B66F 3/22* (2013.01); *B66F 7/0608* (2013.01)

(58) Field of Classification Search
CPC ..... B66F 3/22; B66F 7/0658; B66F 7/0666; B66F 7/0608; F16M 11/18; F16M 11/38
(Continued)

(56) References Cited

U.S. PATENT DOCUMENTS 5,285,992 A * 2/1994 Brown ..... F16M 11/38 248/421
5,445,353 A * 8/1995 Sakamoto ..... A61D 3/00 248/185.1

(Continued)

FOREIGN PATENT DOCUMENTS

CN 111891971 A * 11/2020

*Primary Examiner* — Mahdi H Nejad
(74) *Attorney, Agent, or Firm* — Hall Estill Law Firm

(57) ABSTRACT

A lifting and support apparatus having a fully lowered position, a fully extended position and many transitional positions. The lifting and support apparatus includes a base portion with a first leg, a second leg, a third leg and a fourth leg hingedly attached thereto and extending therefrom. The apparatus can also include a first lateral support element that the first and second legs are extending toward and hingedly connected to and a second lateral support element that the third and fourth legs are extending toward and hingedly connected to. The apparatus further includes a lift support portion that has a fifth leg, a sixth leg, a seventh leg and an eighth leg hingedly connected thereto and extending therefrom, the fifth and sixth legs extending to and hingedly connected to the first lateral support element and the seventh and eighth legs extending to and hingedly connected to the second lateral support element. In addition, the apparatus has a drive apparatus and threaded shaft for forcing the first lateral support element and the second lateral support element toward and away from each other, which raises and lowers the lift support portion of the lifting apparatus relative to the base portion. A method of raising or supporting an object with a lifting and support apparatus. The method includes placing the lifting and support apparatus in a desired position relative to the object to be raised and supported. The method also includes actuating the lifting and support apparatus to raise the object to a desired height.

18 Claims, 7 Drawing Sheets

(58) Field of Classification Search
USPC ..... 254/122
See application file for complete search history.

(56) References Cited

U.S. PATENT DOCUMENTS 8,740,191 B2 * 6/2014 Litcher ..... B66F 3/22
254/122
2014/0374680 A1 * 12/2014 Tsang ..... B62B 3/0612
254/7 C

* cited by examiner

LIFTING AND SUPPORT APPARATUS

CROSS-REFERENCE TO RELATED APPLICATIONS

The present application is a conversion of U.S. Provisional Application having U.S. Ser. No. 63/135,971, filed Jan. 11, 2021, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a lifting and support apparatus for raising, lowering, and supporting various objects to a desirable height without including any sliding elements for its operation.

2. Description of the Related Art

It is typical for a scissor jack to consist of a single set of opposing linked arms, connected in the center of a base, forming a parallelogram aligned in a planar configuration with a horizontal screw used for adjustment. This configuration lacks stability when a force is applied to the jack. Other scissor-lift lifting and support apparatuses consist of multiple spaced apart parallelograms in order to provide more stability but they typically include some sliding elements to facilitate the raising and lowering of objects to a certain height. These sliding elements inevitably create failure points for the lifting apparatus.

Accordingly, there is a need for a lifting and support apparatus that provides additional stability and does not include any sliding elements to achieve a desired height.

SUMMARY OF THE DISCLOSURE

The present disclosure is directed to a lifting and support apparatus having a fully lowered position, a fully extended position and many transitional positions. The lifting and support apparatus includes a base portion with a first leg, a second leg, a third leg and a fourth leg hingedly attached thereto. The first, second, third and fourth legs extend from the base portion. The apparatus can also include a first lateral support element that the first and second legs are extending toward and hingedly connected to and a second lateral support element that the third and fourth legs are extending toward and hingedly connected to. The apparatus further includes a lift support portion that has a fifth leg, a sixth leg, a seventh leg and an eighth leg hingedly connected thereto and extending therefrom, the fifth and sixth legs extending to and hingedly connected to the first lateral support element and the seventh and eighth legs extending to and hingedly connected to the second lateral support element. In addition, the apparatus has a drive apparatus and threaded shaft for forcing the first lateral support element and the second lateral support element toward and away from each other, which raises and lowers the lift support portion of the lifting apparatus relative to the base portion.

The present disclosure is also directed to a method of raising or supporting an object with a lifting and support apparatus. The method includes placing the lifting and support apparatus in a desired position relative to the object to be raised and supported. The method also includes actuating the lifting and support apparatus to raise the object to a desired height.

DETAILED DESCRIPTION OF THE DISCLOSURE

Figure 1:
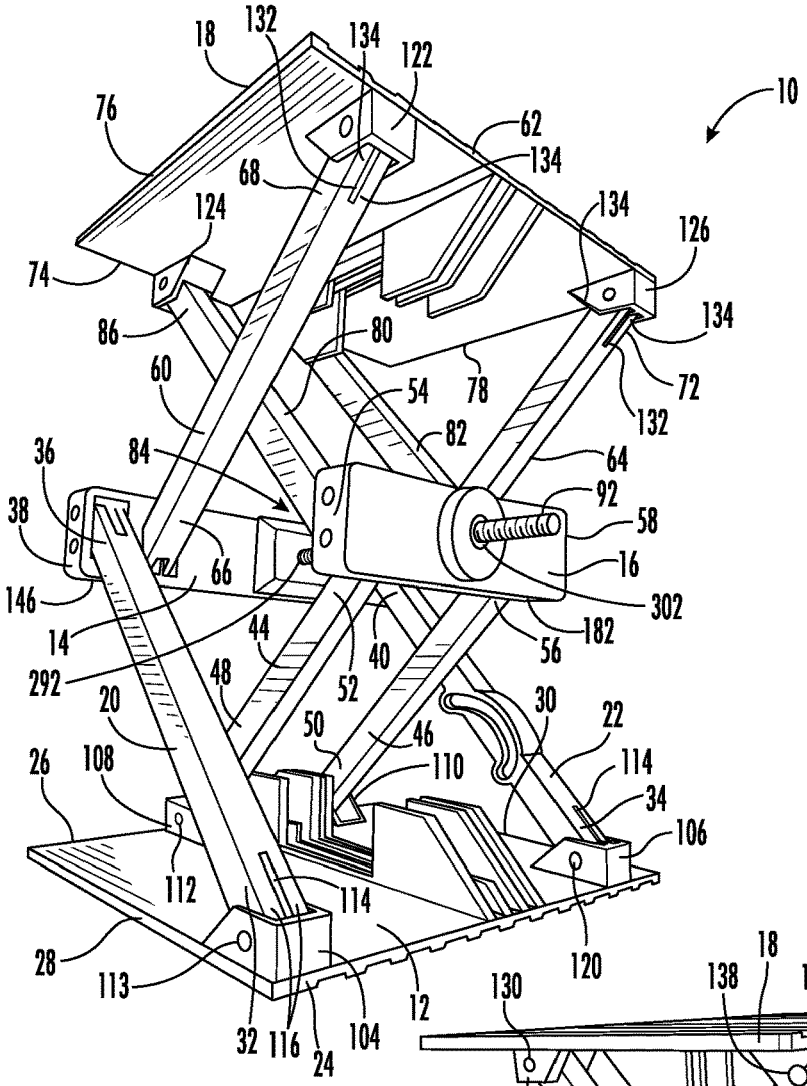
FIG. 1 is a perspective view of a lifting apparatus in a fully extended position constructed in accordance with the present disclosure.
Figure 2A:
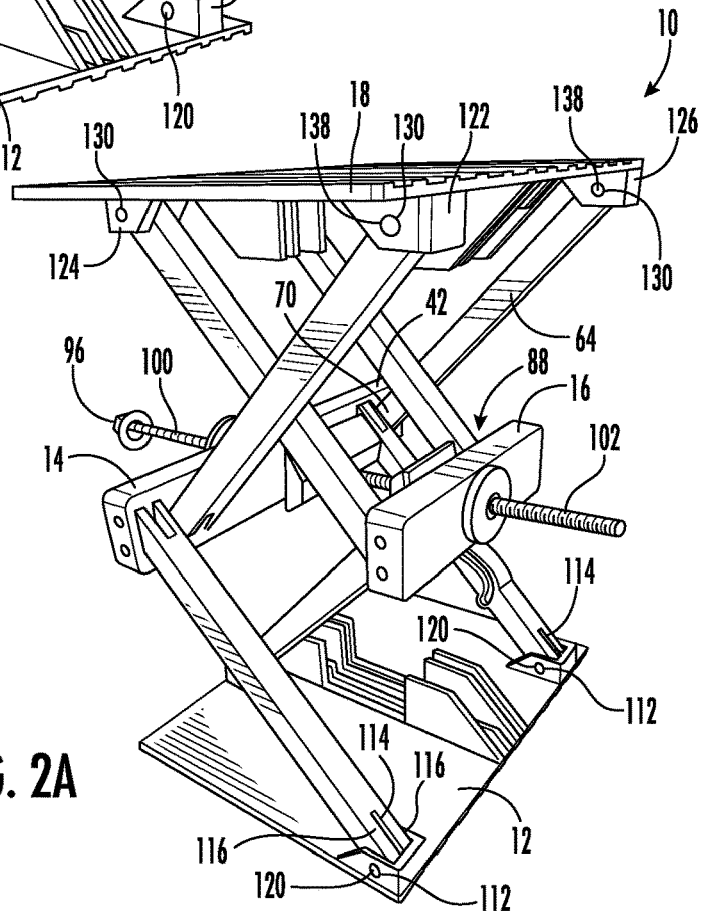
FIG. 2A is another perspective view of the lifting apparatus in the fully extended position constructed in accordance with the present disclosure
Figure 2B:
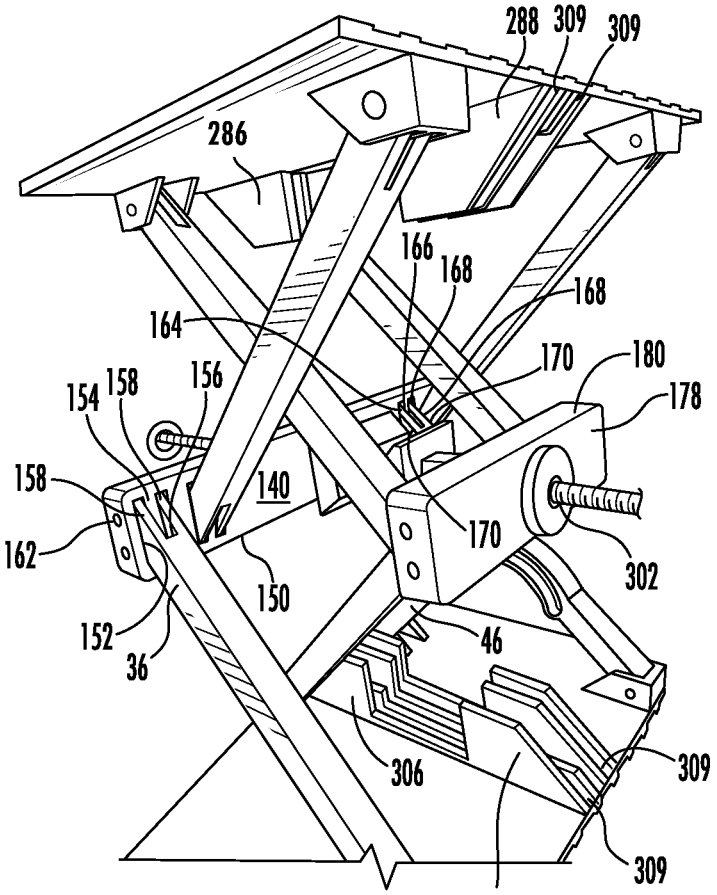
FIG. 2B is another perspective view of a portion of the lifting apparatus in the fully extended position constructed in accordance with the present disclosure.
Figure 3:
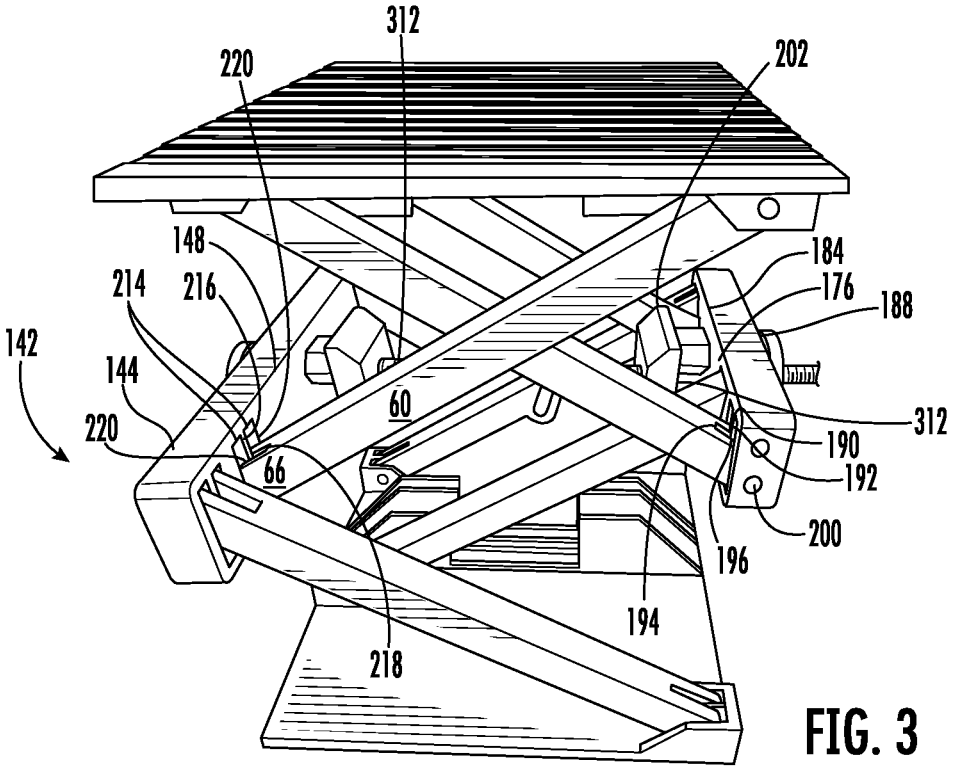
FIG. 3 is a perspective view of the lifting apparatus in a transitional position constructed in accordance with the present disclosure.
Figure 4A:
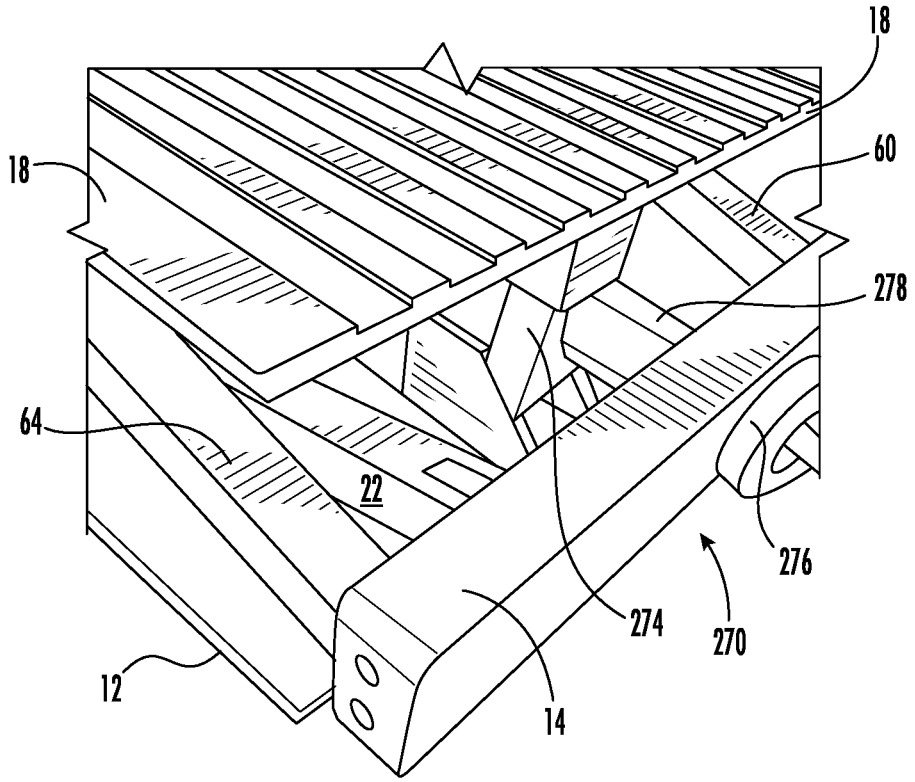
FIG. 4A is a perspective view of a part of the lifting apparatus in a transitional position constructed in accordance with the present disclosure.
Figure 4B:
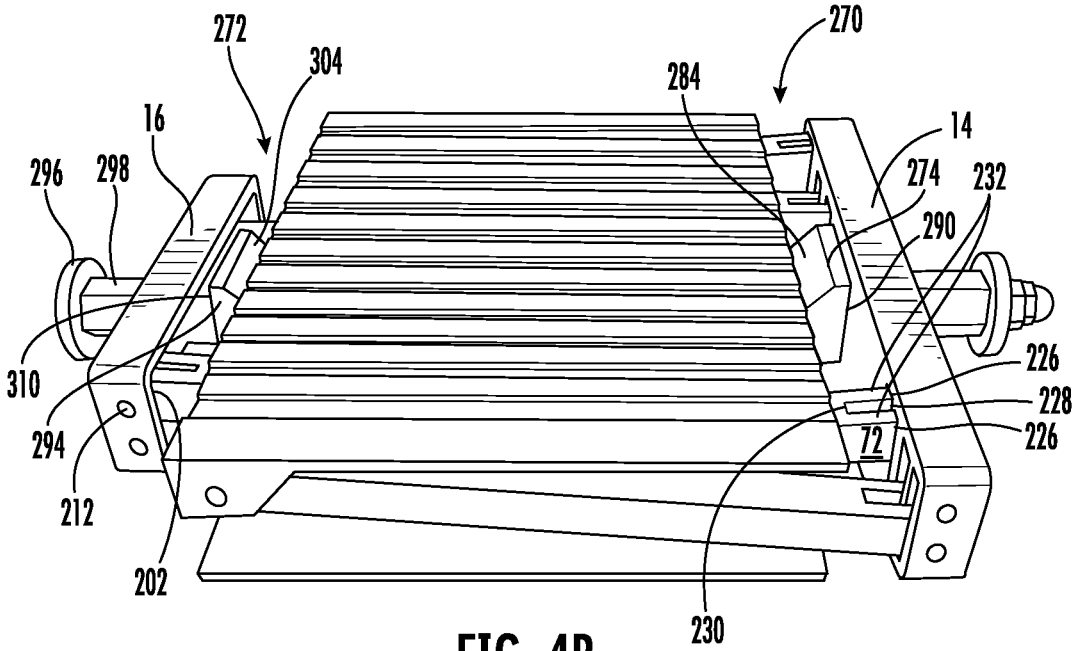
FIG. 4B is a perspective view of the lifting apparatus in a fully lowered position constructed in accordance with the present disclosure.
Figure 4C:
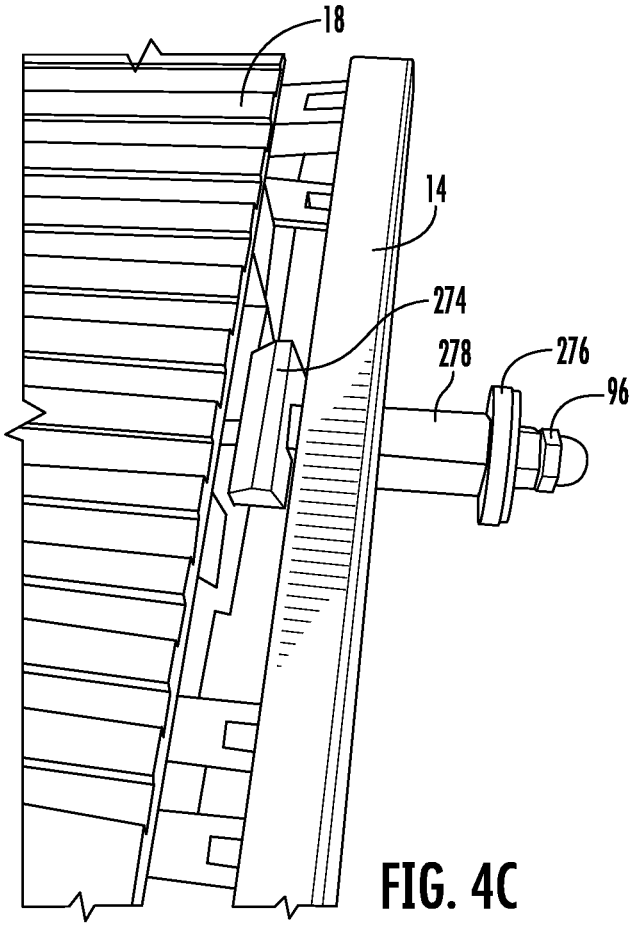
FIG. 4C is a perspective view of a part of the lifting apparatus in the fully lowered position constructed in accordance with the present disclosure.
Figure 4D:
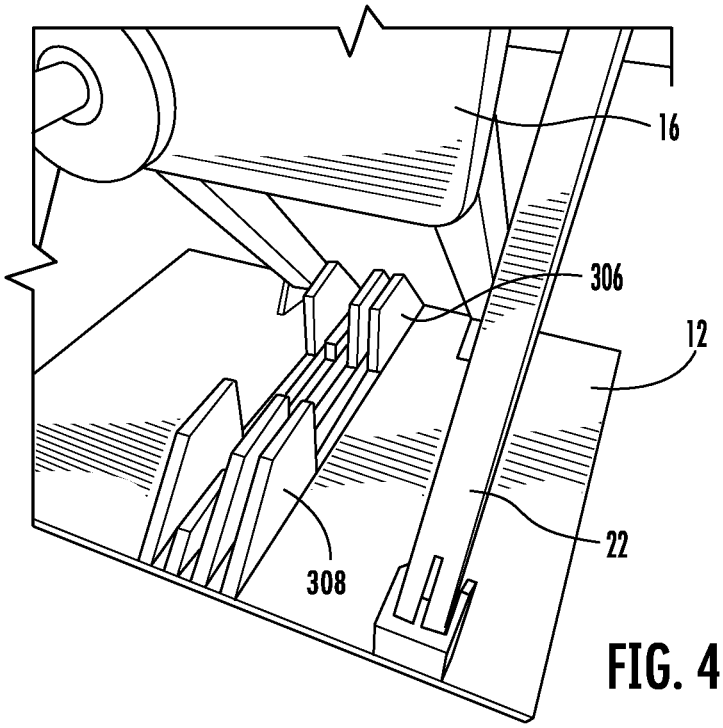
FIG. 4D is a perspective view of a part of the lifting apparatus in a transitional position constructed in accordance with the present disclosure.
Figure 4E:
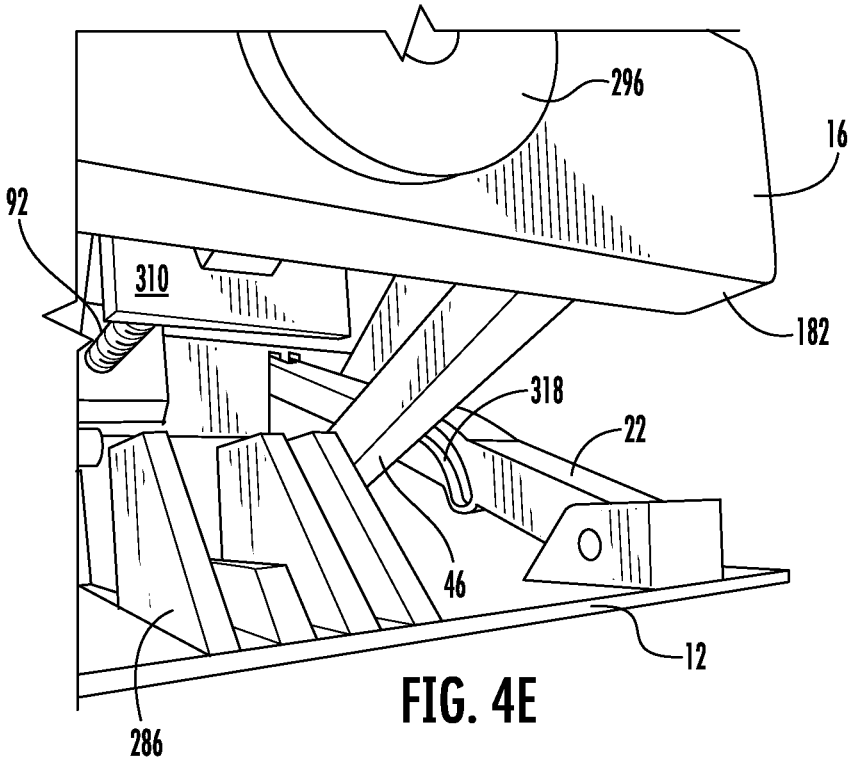
FIG. 4E is a perspective view of a part of the lifting apparatus in a transitional position constructed in accordance with the present disclosure.

Referring now to FIGS. 1-6, shown therein is a lifting apparatus 10 for raising, lowering, and supporting objects at a desired height. The apparatus 10 includes a base portion 12, a first lateral support element 14, a second lateral support element 16 and a lift support portion 18. The base portion 12 provides the lifting apparatus 10 a steady base to support the lifting apparatus 10. The lift support portion 18 engages and supports whatever object is desired to be lifted and/or supported by the lifting apparatus 10. The lift support portion 18 can have any shape to enable desired engagement with objects to be lifted/supported and so that the lifting apparatus 10 can still operate as described herein. In one embodiment of the present disclosure, the lift support portion 18 can be a platform.

The lifting apparatus 10 includes a first leg 20 and a second leg 22 hingedly supported by a first side 24 (or first edge) of the base portion 12. The base portion 12 includes a second side 26 (or second edge), third side 28 (or third edge) and a fourth side 30 (or fourth edge). The first and second legs 20 and 22 extend from the first side 24 of the base portion 12 to the first lateral support element 14. More specifically, a first end 32 of the first leg 20 can extend from the first side 24 of the base portion 12 close to the second side 26 of the base portion 12. Similarly, a first end 34 of the second leg 22 can extend from the first side 24 of the base portion 12 close to the third side 28 of the base portion 12. A second end 36 of the first leg 20 hingedly engages a first end 38 of the first lateral support element 14 and a second end 40 of the second leg 22 hingedly engages with a second end 42 of the first lateral support element 14.

The lifting apparatus 10 includes a third leg 44 and a fourth leg 46 hingedly supported by the fourth side 30 of the base portion 12. The third and fourth legs 44 and 46 extend from the fourth side 30 of the base portion 12 to the second lateral support element 16. More specifically, a first end 48 of the third leg 44 can extend from the fourth side 30 of the base portion 12 and be positioned laterally inside of the first leg 20 of the lifting apparatus 10. Similarly, a first end 50 of the fourth leg 46 can extend from the fourth side 30 of the base portion 12 that is positioned laterally inside of the second leg 22 of the lifting apparatus 10. A second end 52 of the third leg 44 hingedly engages a first end 54 of the second lateral support element 16 and a second end 56 of the fourth leg 46 hingedly engages with a second end 58 of the second lateral support element 16.

The lifting apparatus 10 further includes a fifth leg 60 extending from the first end 38 of the first lateral support element 14 to a first end 62 (or first edge) of the lift support portion 18 and a sixth leg 64 that extends from the second end 42 of the first lateral support element 14 to the first end 62 of the lift support portion 18. The fifth leg 60 is generally aligned with the first leg 20 and the sixth leg 64 is generally aligned with the second leg 22. A first end 66 of the fifth leg 60 is hingedly attached to the first end 38 of the first lateral support element 14 and a second end 68 of the fifth leg 60 is hingedly attached to the first end 62 of the lift support portion 18. Similarly, a first end 70 of the sixth leg 64 is hingedly attached to the second end 42 of the first lateral support element 14 and a second end 72 of the sixth leg 64 is hingedly attached to the first end 62 of the lift support portion 18. In addition to the first end 62, the lift support portion 18 includes a second end 74 (or second edge) and a third end 76 (or third edge) adjacent to the first end 62, and a fourth end 78 (or fourth edge) opposite the first end 62 of the lift support portion 18. The second end 68 of the fifth leg 60 is hingedly attached to the first end 62 of the lift support portion 18 close to the second end 72 of the lift support portion 18 and the second end 72 of the sixth leg 64 is hingedly attached to the first end 62 of the lift support portion 18 close to the third end 76 of the lift support portion 18.

The lifting apparatus 10 further includes a seventh leg 80 extending from the first end 54 of the second lateral support element 16 to the fourth end 78 of the lift support portion 18 and an eighth leg 82 that extends from the second end 58 of the second lateral support element 16 to the fourth end 78 of the lift support portion 18. The seventh leg 80 is generally aligned with the third leg 44 and the eighth leg 82 is generally aligned with the fourth leg 46. A first end 84 of the seventh leg 80 is hingedly attached to the first end 54 of the second lateral support element 16 and a second end 86 of the seventh leg 80 is hingedly attached to the fourth end 78 of the lift support portion 18. Similarly, a first end 88 of the eighth leg 82 is hingedly attached to the second end 58 of the second lateral support element 16 and a second end 90 of the eighth leg 82 is hingedly attached to the fourth end 78 of the lift support portion 18. More specifically, the first end 84 of the seventh leg 80 can extend from the fourth end 78 of the lift support portion 18 and be positioned laterally inside of the fifth leg 60 of the lifting apparatus 10. Similarly, the first end 88 of the eighth leg 82 can extend from the fourth end 78 of the lift support portion 18 that is positioned laterally inside of the sixth leg of the lifting apparatus 10.

The first lateral support element 14 can rotatably support a threaded shaft 92 that extends through a threaded opening (not shown) in the second lateral support element 16. The threaded shaft 92 can include a drive apparatus 96 to turn the threaded shaft 92. The drive apparatus 96 can be set up in any manner such that it can turn the threaded shaft 92. In one embodiment, the drive apparatus 96 includes a hexagon shaped protrusion that can be engaged with a tool to turn the threaded shaft 92. In another embodiment, the drive apparatus 96 can include a shaped depression area for receiving a tool (e.g. Allen wrench) to turn the threaded shaft 92. Depending on the direction the threaded shaft 92 is turned, the second lateral support element 16 can be pulled toward the first lateral support element 14 or forced away from the first lateral support element 14. It should be understood and appreciated that the first and second lateral support elements 14 and 16 are interchangeable with regard to the operation of lifting apparatus 10. It should also be understood that the drive apparatus 96 can include any features required to turn the threaded shaft 92.

In another embodiment, the second lateral support element 16 can include a threaded opening (not shown) therein that is also threadably engaged with the threaded shaft 92. In this embodiment, the threaded shaft 92 can include a first threaded section 100 (shown in FIG. 2A) threaded one direction (e.g. right hand threaded) on one end and second threaded section 102 (shown in FIG. 2A) threaded another direction (e.g. left hand threaded) on the other end of the threaded shaft 92. The threaded openings 94 and 94 in the first and second lateral support elements 14 and 16 are threaded such that when the threaded shaft 92 is turned one direction, the first and second lateral support elements 14 and 16 move away from each other. Conversely, when the threaded shaft 92 is turned the other direction, the first and second lateral support elements 14 and 16 move toward each other.

In one embodiment, the hinge relationships between the legs 20, 22, 44 and 46 and the base portion 12 and between the legs 60, 64, 80 and 82 and the lift support portion 18 are similar. Furthermore, in certain embodiments, the relationship between the legs 20, 22, 44 and 46 and the base portion 12 and between the legs 60, 64, 80 and 82 and the lift support portion 18 are non-slidable. The base portion 12 can include at least one first extended portion 104 protruding upward therefrom that can hingedly engage with the first end 32 of the first leg 20. Similarly, the base portion 12 can include at least one second extended portion 106, at least one third extended portion 108 and at least one fourth extended portion 110 protruding upward from the base portion 12 that can hingedly engage with the first end 34 of the second leg 22, the first end 48 of the third leg 44 and the first end 50 of the fourth leg 46, respectively. Each extended portion 104, 106, 108 and 110 that protrudes from the base portion 12 has a lateral opening 112 disposed therethrough. The ends 32, 34, 48 and 50 of each of the first 20, second 22, third 44 and fourth leg 46 has at least one slot 114 disposed therein for engaging with the first, second, third and fourth extended portions 104, 106, 108 and 110 protruding from the base portion 12, respectively. The at least one slot 114 disposed in the ends 32, 34, 48 and 50 of the first, second, third, and fourth legs 20, 22, 44 and 46 is designed to matingly engage the first, second, third, and fourth extended portions 104, 106, 108 and 110, respectively, that protrude from the base portion 12. When the at least one slot 114 is disposed in the first ends 32, 34, 48 and 50 of the first, second, third and fourth legs 20, 22, 44 and 46, extension members 116 are created adjacent to each slot 114. The extension members 116 for each leg 20, 22, 44 and 46 can include a laterally disposed openings (inferable, but not shown) therein that can be generally aligned with the lateral openings 112 disposed in the extended portions that protrude from the base portion 12. Pins 120 can be inserted through the lateral openings 112 in the extended portions 104, 106, 108 and 110 and the laterally disposed openings (inferable, but not shown) in the extension members 116 from the legs 20, 22, 44 and 46 to facilitate the hinged relationship between the first, second, third and fourth legs 20, 22, 44 and 46 and the base portion 12.

Similar to the base portion 12, the lift support portion 18 can include at least one first extended portion 122 protruding downward therefrom that can hingedly engage with the second end 68 of the fifth leg 60. Similarly, the lift support portion 18 can include at least one second extended portion 124, at least one third extended portion 126 and at least one fourth extended portion (inferable, but not shown) protruding downward from the lift support portion 18 that can hingedly engage with the second end 72 of the sixth leg 64, the second end 86 of the seventh leg 80 and the second end 90 of the eighth leg 82, respectively. Each extended portion 122, 124, 126 and 128 that protrudes from the lift support portion 18 has a lateral opening 130 disposed therethrough. The second end 68, 72, 86 and 90 of each of the fifth, sixth, seventh and eighth leg 60, 64, 80 and 82 has at least one slot 132 disposed therein for engaging with the first, second, third and fourth extended portions 122, 124, 126 and 128 protruding from the lift support portion 18, respectively. The at least one slot 132 disposed in the ends 68, 72, 86 and 90 of the fifth, sixth, seventh and eighth legs 60, 64, 80 and 82 is designed to matingly engage the first, second, third, and fourth extended portions 122, 124, 126 and 128, respectively, that protrude from the lift support portion 18. When the at least one slot 132 is disposed in the second ends 68, 72, 86 and 90 of the fifth, sixth, seventh and eighth legs 60, 64, 80 and 82, extension members 134 are created adjacent to each slot 132. The extension members 134 for each leg 60, 64, 80 and 82 can include a laterally disposed opening (inferable, but not shown) therein that can be generally aligned with the lateral openings 130 disposed in the extended portions 122, 124, 126 and 128 that protrude from the lift support portion 18. Pins 138 can be inserted through the lateral openings 130 in the extended portions 122, 124, 126 and 128 and the laterally disposed openings (inferable, but not shown) in the extension members 134 from the legs 60, 64, 80 and 82 to facilitate the hinged relationship between the fifth, sixth, seventh and eighth legs 60, 64, 80 and 82 and the lift support portion 18.

In addition to the hinged connection with the base portion 12 and the lift support portion 18, some of the legs have a hinged connection with the first lateral support element 14 and some of the legs have a hinged connection with the second lateral support element 16. The first lateral support element 14 includes an inside part 140, outside part 142, top part 144 and a bottom part 146. The inside part 140 and the top part 144 cooperate to create a top corner 148 and the inside part 140 and the bottom part 146 cooperate to create a bottom corner 150. The bottom corner 150 or inside part 140 of the first end 38 of the first lateral support element 14 can have a first set of slots 152 disposed therein, which creates a first set of fin elements 154 between the first slots 152. The second end 36 of the first leg 20 can have at least one slot 156 disposed therein that can matingly engage with the fin elements 154 created by the slots 152 in the bottom corner 150 or inside part 140 of the first end 38 of the first lateral support element 14. The fin elements 154 in the bottom corner 150 or inside part 140 of the first end 38 of the first lateral support element 14 and fin elements 158 disposed on the second end 36 of the first leg 20 can include laterally disposed openings (inferable, but not shown) therein that are generally aligned. A pin element 162 can be inserted into the openings (inferable, but not shown) in the fin elements 154, 158 to facilitate the hinged relationship between the first end 38 of the first lateral support element 14 and the second end 36 of the first leg 20.

Similarly, the bottom corner 150 or inside part of 140 of the second end 42 of the first lateral support element 14 can have a second set of slots 164 disposed therein, which creates at least one fin element 166 between the second slots 164. The second end 40 of the second leg 22 can have at least one slot 168 disposed therein that can matingly engage with the fin elements 166 created by the slots 164 in the bottom corner 150 or inside part of 140 of the second end 142 of the first lateral support element 14. The fin elements 166 in the bottom corner 150 or inside part of 140 of the second end 42 of the first lateral support element 14 and fin elements 170 disposed on the second end of the second leg 22 can include laterally disposed openings (inferable, but not shown) therein that are generally aligned. A pin element (inferable, but not shown) can be inserted into the openings (inferable, but not shown) in the fin elements 166 and 170 to facilitate the hinged relationship between the second end 42 of the first lateral support element 14 and the second end 40 of the second leg 22.

The second lateral support element 16 includes an inside part 176, outside part 178, top part 180 and a bottom part 182. The inside part 176 and the top part 180 cooperate to create a top corner 184 and the inside part 176 and the bottom part 182 cooperate to create a bottom corner 186. The bottom corner 186 or inside part of 176 of the first end 54 of the second lateral support element 16 can have a first set of slots 190 disposed therein, which creates at least one fin element 192 between the first slots 190. The second end 52 of the third leg 44 can have at least one slot disposed therein that can matingly engage with the at least one fin element 192 created by the slots 190 in the bottom corner 188 or inside part of 176 of the first end 54 of the second lateral support element 16. The at least one fin element 192 in the bottom corner 188 or inside part of 176 of the first end 54 of the second lateral support element 16 and fin elements 196 disposed on the second end 52 of the third leg 44 can include laterally disposed openings (inferable, but not shown) therein that are generally aligned. A pin element 200 can be inserted into the openings (inferable, but not shown) in the fin elements 192 and 196 to facilitate the hinged relationship between the first end 54 of the second lateral support element 16 and the second end 52 of the third leg 44.

Similarly, the bottom corner 188 or inside part of 176 of the second end 58 of the second lateral support element 16 can have a second set of slots 202 disposed therein, which creates at least one fin element 204 between the second slots 202. The second end 56 of the fourth leg 46 can have at least one slot 206 disposed therein that can matingly engage with the fin element 204 created by the slots 202 in the bottom corner 188 or inside part of 176 of the second end 58 of the second lateral support element 16. The fin element 204 in the bottom corner 188 or inside part of 176 of the second end 58 of the second lateral support element 16 and fin elements 208 disposed on the second end 56 of the fourth leg 46 can include laterally disposed openings (inferable, but not shown) therein that are generally aligned. A pin element 212 can be inserted into the openings (inferable, but not shown) in the fin elements 204 and 208 to facilitate the hinged relationship between the second end 58 of the second lateral support element 16 and the second end 56 of the fourth leg 46.

The top corner 148 or inside part of 140 of the first end 38 of the first lateral support element 14 can have a third set of slots 214 disposed therein, which creates at least on fin element 216 between the third slots. The first end 66 of the fifth leg 60 can have at least one slot 218 disposed therein that can matingly engage with the fin element 216 created by the slots 214 in the top corner 148 or inside part of 140 of the first end 38 of the first lateral support element 14. The fin elements 216 in the top corner 148 or inside part of 140 of the first end 38 of the first lateral support element 14 and at least one fin element 220 disposed on the second end 68 of the fifth leg 60 can include laterally disposed openings (inferable, but not shown) therein that are generally aligned. A pin element (inferable, but not shown) can be inserted into the openings (inferable, but not shown) in the fin elements 216 and 220 to facilitate the hinged relationship between the first end 38 of the first lateral support element 14 and the second end 68 of the fifth leg 60.

Similarly, the top corner 148 or inside part of 140 of the second end 42 of the first lateral support element 14 can have a fourth set of slots 226 disposed therein, which creates at least one fin element 228 between the fourth slots 226. The first end 70 of the sixth leg 64 can have at least one slot 230 disposed therein that can matingly engage with the fin element 228 created by the slots 226 in the top corner 148 or inside part of 140 of the second end 38 of the first lateral support element 14. The fin element 228 in the top corner 148 or inside part of 140 of the second end 38 of the first lateral support element 14 and fin elements 232 disposed on the second end 72 of the sixth leg 64 can include laterally disposed openings (inferable, but not shown) therein that are generally aligned. A pin element (inferable, but not shown) can be inserted into the openings (inferable, but not shown) in the fin elements 228 and 232 to facilitate the hinged relationship between the second end 38 of the first lateral support element 14 and the second end 72 of the sixth leg 64.

The top corner 184 or inside part of 176 of the first end 54 of the second lateral support element 16 can have a third set of slots 238 disposed therein, which creates at least one fin element 240 between the third slots 238. The first end end 84 of the seventh leg 80 can have at least one slot 242 disposed therein that can matingly engage with the fin element 240 created by the slots 238 in the top corner 184 or inside part of 176 of the first end 54 of the second lateral support element 16. The fin element 240 in the top corner 184 or inside part of 176 of the first end 54 of the second lateral support element 16 and fin elements 244 disposed on the second end 86 of the seventh leg 80 can include laterally disposed openings (inferable, but not shown) therein that are generally aligned. A pin element (inferable, but not shown) can be inserted into the openings (inferable, but not shown) in the fin elements 240 and 244 to facilitate the hinged relationship between the first end 54 of the second lateral support element 16 and the second end 86 of the seventh leg 80.

Similarly, the top corner 188 or inside part of 176 of the second end 58 of the second lateral support element 16 can have a fourth set of slots 250 disposed therein, which creates at least one fin element 252 between the fourth slots 250. The first end 88 of the eighth leg 82 can have at least one slot 256 disposed therein that can matingly engage with the fin element 252 created by the slots 250 in the top corner 188 or inside part of 176 of the second end 58 of the second lateral support element 16. The fin element 252 in the top corner 188 or inside part of 176 of the second end 58 of the second lateral support element 16 and fin elements 258 disposed on the second end 90 of the eighth leg 82 can include laterally disposed openings (not clearly shown) therein that are generally aligned. A pin element (not clearly shown) can be inserted into the openings (not clearly shown) in the fin elements 252 and 258 to facilitate the hinged relationship between the second end 58 of the second lateral support element 16 and the second end 90 of the eighth leg 82.

The lateral openings in the fin elements at the top corner of the first lateral support element 14 and the fin elements at the bottom corner of the first lateral support are separate openings and are spaced such that the lift support portion 18 can achieve the desirable height without the need to for any sliding engagement of any parts of the lifting apparatus 10. Similarly, the lateral openings in the fin elements at the top corner of the second lateral support element 16 and the fin elements at the bottom corner of the second lateral support are separate openings and are spaced such that the lift support portion 18 can achieve the desired height.

It should be understood and appreciated that all of the hinged relationships between the legs and the base portion 12, the legs and the lift support portion 18 and the legs and the lateral support elements can have any type of hinged relationship known in the art.

In a further embodiment of the present disclosure and shown in more detail in FIGS. 4A-4E, the lift apparatus 10 can include first lift initiator 270 and a second lift initiator 272 supported by the first and second lateral support elements, respectively, to facilitate the transition of the lift apparatus 10 from a lowered position to a raised position. The lowered position is the position of the lift apparatus 10 completely lowered and the raised position can be the lift apparatus 10 at any desired height, including but not limited to, the upmost height of the lifting apparatus 10. The first lift initiator 270 can include a wedge 274, a flange 276 and a sleeve 278 extending between the wedge 274 and the flange 276. The sleeve 278 can extend through an opening 280 disposed in the first lateral support element 14. The wedge 274 is disposed on the end of the sleeve 278 on the inside of the first lateral support element 14 and the flange 276 is disposed on the end of the sleeve 278 on the outside of the first lateral support element 14. The wedge 274 can also include a back side 290 to prevent movement of the first lift initiator 270 too far in one direction and the flange 276 prevents movement too far in the opposite direction. The sleeve 278 and the opening 280 can be shaped (cross-sectionally) so that the sleeve 278 cannot rotate in the first lateral support element 14 and the wedge 274 cannot rotate. The flange 276 can include an opening 282 for receiving the threaded shaft 92 of the lifting apparatus 10. The opening 282 in the flange 276 can be threaded or unthreaded depending upon how the lifting apparatus is set up. The wedge 274, disposed on the opposite side of the first lateral support element 14 from the flange 276, can include a wedge side 284 to be driven between a first ramp 286 disposed on the base portion 12 and a second ramp 288 disposed on the lift support portion 18 to more efficiently initiate the lifting of the lift support portion 18 when transitioning the lifting apparatus 10 from the lowered position to a raised position. The wedge 274 can also include an opening 292 disposed therein to permit the threaded shaft 92 to pass therethrough.

Similar to the first lift initiator 270, the second lift initiator 272 can include a wedge 294, a flange 296 and a sleeve 298 extending between the wedge 294 and the flange 296. The sleeve 298 can extend through an opening 300 disposed in the second lateral support element 16. The wedge 294 is disposed on the end of the sleeve 298 on the inside of the second lateral support element 16 and the flange 296 is disposed on the end of the sleeve 298 on the outside of the second lateral support element 16. The wedge 294 can also include a back side 310 to prevent movement of the second lift initiator 272 too far in one direction. The sleeve 298 and the opening 300 can be shaped (cross-sectionally) so that the sleeve 298 cannot rotate in the second lateral support element 16 and the wedge 294 cannot be rotated. The flange 296 can include an opening 302 for receiving the threaded shaft 92 of the lifting apparatus 10. The opening 302 in the flange 296 can be threaded or unthreaded depending upon how the lifting apparatus is set up. The wedge 294, disposed on the opposite side of the second lateral support element 16 from the flange 296, can include a wedge side 304 to be driven between a third ramp 306 disposed on the base portion 12 and a fourth ramp 308 disposed on the lift support portion 18 to more efficiently initiate the lifting of the lift support portion 18 when transitioning the lifting apparatus 10 from the lowered position to a raised position. The wedge 294 can also include an opening 312 disposed therein to permit the threaded shaft 92 to pass therethrough. In a further embodiment, the ramp portions 286, 288, 306 and 308 can have cut out sections 309 where the threaded shaft 92 and other parts of the ramps (that come together) can be disposed when the lifting apparatus 10 is in the lowered position.

Figure 5A:
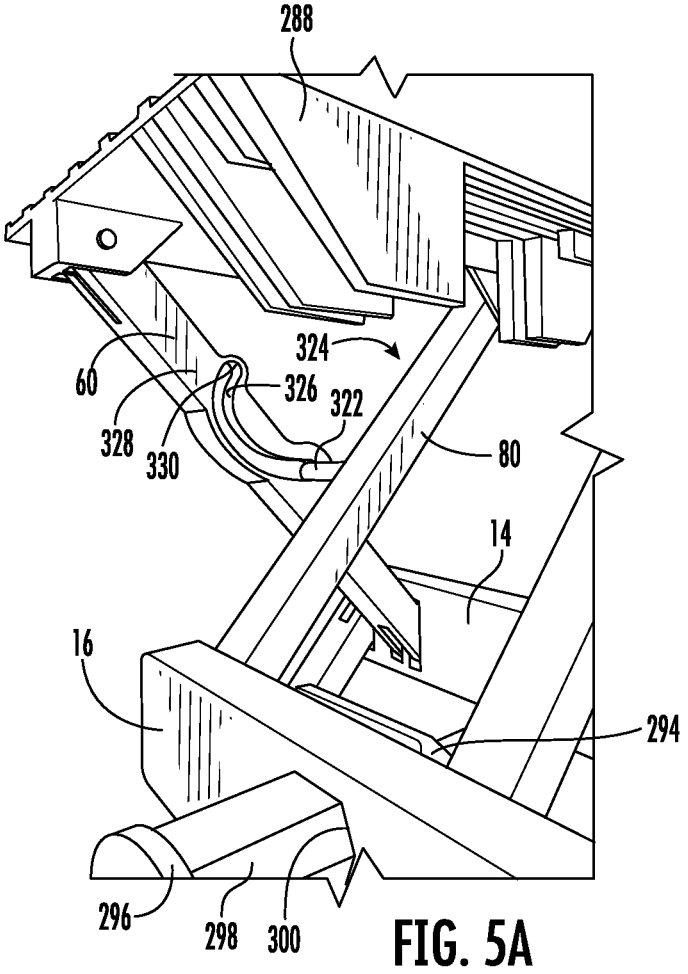
FIG. 5A is a perspective view of a part of the lifting apparatus in a transitional position constructed in accordance with the present disclosure.
Figure 5B:
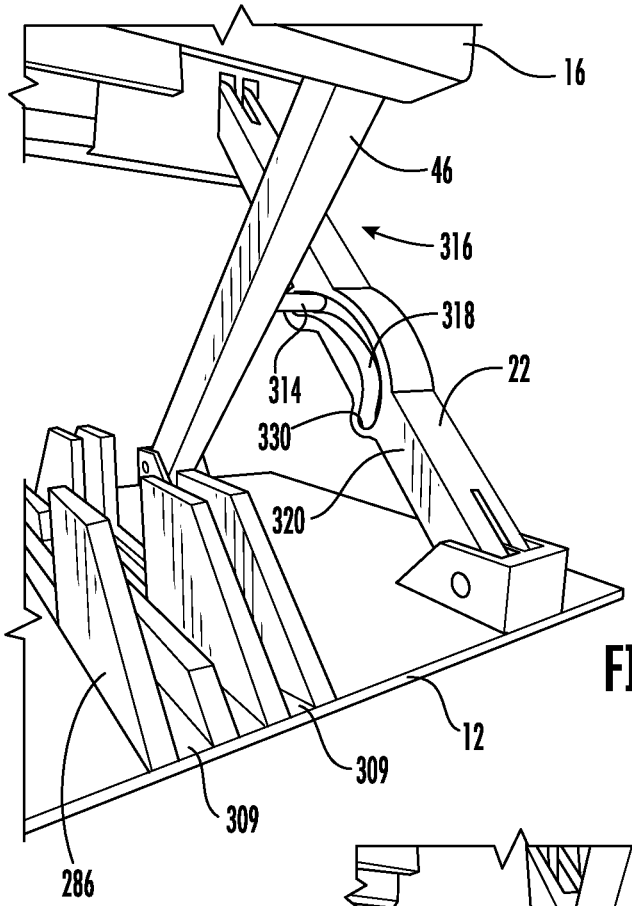
FIG. 5B is a perspective view of a part of the lifting apparatus in a transitional position constructed in accordance with the present disclosure.
Figure 5C:
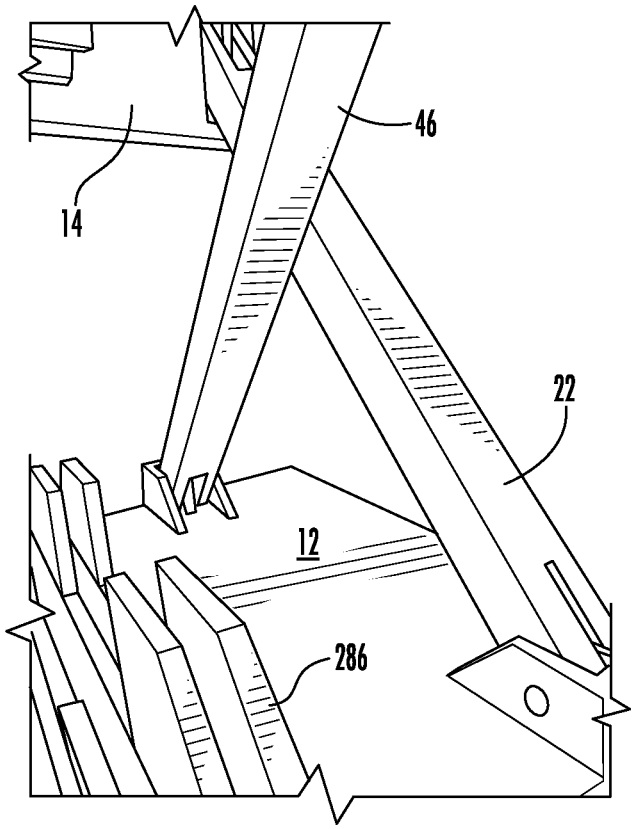
FIG. 5C is a perspective view of a part of the lifting apparatus in a transitional position constructed in accordance with the present disclosure.
Figure 6:
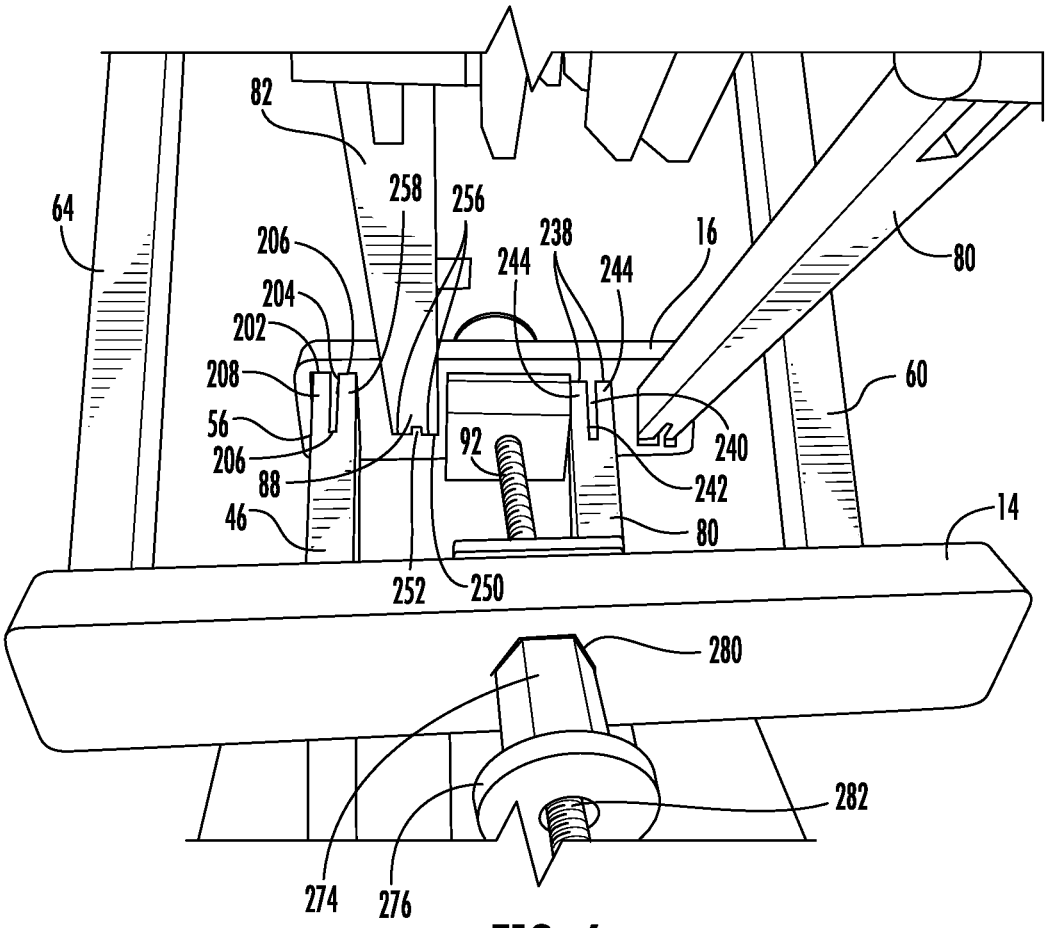
FIG. 6 is a perspective view of a part of the lifting apparatus in a transitional position constructed in accordance with the present disclosure.

In another embodiment of the present disclosure shown in more detail in FIGS. 5A and 5B, the lifting apparatus 10 can include a first guiding apparatus and a second guiding apparatus. The first and second guiding apparatuses maintain the lift support portion 18 in a level position as the lift support portion 18 is raised. The first guiding apparatus includes a first guide post 314 extending from an outer side 316 of the fourth leg 46 that can engage with a first guide channel 318 disposed in an inner side 320 of the second leg 22. The outer side of a leg is the side that faces outward from the center (direction of the threaded shaft) of the lifting apparatus and the inner side of a leg is the side that faces toward the center of the lifting apparatus. The second guiding apparatus includes a second guide post 322 extending from an outer side 324 of the seventh leg 80 that can engage with a second guide channel 326 disposed in an inner side 328 of the fifth leg 60. The guide channels 318 and 326 can be any shape that the guide posts 314 and 322 can travel through the guide channels 318 and 326 as the lifting apparatus 10 travels back and forth between the lowered position and the raised position. In one embodiment, the guide channels 318 and 326 are generally C-shaped. In a further embodiment, ends 330 straighten to permit the guide posts 314 and 322 to set more securely when the lifting apparatus 10 is in the lowered position or the fully raised position.

The lifting apparatus 10 can also include a removable connection top that can be selectively securable to the lift support portion 18 to provide the lifting apparatus 10 with multiple options to connect to various objects. This provides the lifting apparatus 10 with many options for use of the lifting apparatus 10.

In yet another embodiment of the present disclosure, the lifting and support apparatus 10 can replace the four internal legs that create two internal leg assemblies as described herein, and have only one internal leg assembly disposed between two outer leg assemblies. One central leg extends from the base portion 12 to the second lateral support element 16 and a second central leg extends from the second lateral support element 16 to the lift support portion 18. Both ends of the legs of the internal leg assembly are hingedly or rotatably attached to the appropriate part of the lifting apparatus 10. The hinged relationship of the ends of the central legs can be executed in any of the ways described herein.

In another embodiment, the second lateral support element 16 can include a block element that extends toward the first lateral support element 14. The block is sized such that the width of the block is just barely smaller than the distance between the third and fourth legs 44 and 46 and the distance between the seventh and eighth legs 80 and 82. The block portion can act as an internal stabilizer for the legs.

The ends of the legs of the lifting apparatus 10, top and bottom corners of the first and second lateral support elements 14 and 16 and the extended portions of the base portion 12 and the lift support portion 18 can be rounded to facilitate the rotational movement of the hinged portions of the lifting apparatus 10.

In an even further embodiment of the present disclosure, a method is disclosed of using the lifting apparatus 10 to raise a desired object, such as a piece of a platform, to a desired height. The method is also directed to the use of many lifting apparatuses 10 to raise multiple pieces of a platform to a desired height for the entire platform. In one embodiment, a single lifting apparatus could be used to raise and support parts of multiple separate pieces of a platform.

The lifting apparatus 10 can also achieve a desirable height in a fully extended position relative to the height of the lifting apparatus 10 in a fully lowered position. In one embodiment, the height of the lifting apparatus 10 in a fully extended position is 3 or more times higher than the height of the lifting apparatus 10 in the fully lowered position. In another embodiment, the height of the lifting apparatus 10 in the fully extended position is 4 or more times higher than the height of the lifting apparatus 10 in the fully lowered position. In yet another embodiment, the height of the lifting apparatus 10 in the fully extended position is 5 or more times higher than the height of the lifting apparatus 10 in the fully lowered position. In one embodiment, the height of the lifting apparatus 10 in a fully extended position is 6 or more times higher than the height of the lifting apparatus 10 in the fully lowered position. In another embodiment, the height of the lifting apparatus 10 in the fully extended position is 7 or more times higher than the height of the lifting apparatus 10 in the fully lowered position. In yet another embodiment, the height of the lifting apparatus 10 in the fully extended position is 8 or more times higher than the height of the lifting apparatus 10 in the fully lowered position.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A lifting and support apparatus having a fully lowered position, a fully extended position and many transitional positions, the lifting and support apparatus comprising:

a base portion with a first leg, a second leg, a third leg and a fourth leg hingedly attached thereto to create hinged attachment points; the first, second, third and fourth legs extending from the base portion, the hinged attachment points are set a certain distance from each other wherein the distance between the hinged attachment points remains constant in any position of the lifting and support apparatus;

a first lateral support element that the first and second legs are extending toward and hingedly connected to;

a second lateral support element that the third and fourth legs are extending toward and hingedly connected to;

a lift support portion that has a fifth leg, a sixth leg, a seventh leg and an eighth leg hingedly connected thereto and extending therefrom, the fifth and sixth legs extending to and hingedly connected to the first lateral support element and the seventh and eighth legs extending to and hingedly connected to the second lateral support element;

a drive apparatus and threaded shaft for forcing the first lateral support element and the second lateral support element toward and away from each other, which raises and lowers the lift support portion of the lifting apparatus relative to the base portion;

a first and second ramp disposed on an underside portion of the lift support portion;

a third and fourth ramp disposed on the base portion;

a first wedge portion disposed inside of the first lateral support element, the threaded shaft extending through the first wedge portion, the first wedge portion engages the first and third ramps when the lifting and support apparatus moves from the fully lowered position and facilitates movement of the lift support portion away from the base portion; and a second wedge portion disposed inside of the second lateral support element, the threaded shaft extending through the second wedge portion, the second wedge portion engages the second and fourth ramps when the lifting and support apparatus moves from the fully lowered position and facilitates movement of the lift support portion away from the base portion.

2. The lifting and support apparatus of claim 1 wherein the third and fourth legs are located laterally inside of the first and second legs and the seventh and eighth legs are located laterally inside the fifth and sixth legs.

3. The lifting and support apparatus of claim 2 wherein the fifth and sixth legs are located laterally inside of the first and second legs and wherein the third and fourth legs are located laterally inside the seventh and eighth legs.

4. The lifting and support apparatus of claim 1 wherein the first lateral support element has a first opening disposed therein and the second lateral support element has a second opening disposed therein for receiving the threaded shaft, the first opening or the second opening can be threaded to threadably engage the threaded shaft.

5. The lifting and support apparatus of claim 4 wherein the threaded shaft has a first threaded section and a second threaded section that are threaded in different directions, the first and second openings are threaded to threadably engage the threaded shaft.

6. The lifting and support apparatus of claim 1 wherein the ramps have vertical slots disposed therein to permit the threaded shaft and parts of other ramps to move therein when the lifting and support apparatus is in the fully lowered position.

7. The lifting and support apparatus of claim 1 wherein the second leg has a guide channel disposed therein and the fourth leg has a guide post extending therefrom to slidably engage the guide channel disposed in the second leg.

8. The lifting and support apparatus of claim 7 wherein the fifth leg has a guide channel disposed therein and the seventh leg has a guide post extending therefrom to slidably engage the guide channel disposed in the fifth leg.

9. The lifting and support apparatus of claim 1 wherein the first leg, the second leg, the third leg and the fourth leg are non-slidably attached to the base portion and the fifth leg, the sixth leg, the seventh leg and the eighth leg are non-slidably attached to the lift support portion.

10. A method of raising or supporting an object with a lifting and support apparatus, the method comprises:

placing the lifting and support apparatus in a desired position relative to the object to be raised and supported, the lifting and support apparatus comprising:

a base portion with a first leg, a second leg, a third leg and a fourth leg hingedly attached thereto to create hinged attachment points; the first, second, third and fourth legs extending from the base portion, the hinged attachment points are set a certain distance from each other wherein the distance between the hinged attachment points remains constant in any position of the lifting and support apparatus;

a first lateral support element that the first and second legs are extending toward and hingedly connected to;

a second lateral support element that the third and fourth legs are extending toward and hingedly connected to;

a lift support portion that has a fifth leg, a sixth leg, a seventh leg and an eighth leg hingedly connected thereto and extending therefrom, the fifth and sixth legs extending to and hingedly connected to the first lateral support element and the seventh and eighth legs extending to and hingedly connected to the second lateral support element;

a drive apparatus and threaded shaft for forcing the first lateral support element and the second lateral support element toward and away from each other, which raises and lowers the lift support portion of the lifting apparatus relative to the base portion;

a first and second ramp disposed on an underside portion of the lift support portion;

a third and fourth ramp disposed on the base portion;

a first wedge portion disposed inside of the first lateral support element, the threaded shaft extending through the first wedge portion, the first wedge portion engages the first and third ramps when the lifting and support apparatus moves from the fully lowered position and facilitates movement of the lift support portion away from the base portion; and a second wedge portion disposed inside of the second lateral support element, the threaded shaft extending through the second wedge portion, the second wedge portion engages the second and fourth ramps when the lifting and support apparatus moves from the fully lowered position and facilitates movement of the lift support portion away from the base portion;

actuating the lifting and support apparatus to raise the object to a desired height.

11. The method of claim 10 wherein the third and fourth legs are located laterally inside of the first and second legs and the seventh and eighth legs are located laterally inside the fifth and sixth legs.

12. The method of claim 11 wherein the fifth and sixth legs are located laterally inside of the first and second legs and wherein the third and fourth legs are located laterally inside the seventh and eighth legs.

13. The method of claim 10 wherein the first lateral support element has a first opening disposed therein and the second lateral support element has a second opening disposed therein for receiving the threaded shaft, the first opening or the second opening can be threaded to threadably engage the threaded shaft.

14. The method of claim 13 wherein the threaded shaft has a first threaded section and a second threaded section that are threaded in different directions, the first and second openings are threaded to threadably engage the threaded shaft.

15. The method of claim 10 wherein the ramps have vertical slots disposed therein to permit the threaded shaft and parts of other ramps to move therein when the lifting and support apparatus is in the fully lowered position.

16. The method of claim 10 wherein the second leg has a guide channel disposed therein and the fourth leg has a guide post extending therefrom to slidably engage the guide channel disposed in the second leg.

17. The method of claim 16 wherein the fifth leg has a guide channel disposed therein and the seventh leg has a guide post extending therefrom to slidably engage the guide channel disposed in the fifth leg.

18. The method of claim 10 wherein the first leg, the second leg, the third leg and the fourth leg are non-slidably attached to the base portion and the fifth leg, the sixth leg, the seventh leg and the eighth leg are non-slidably attached to the lift support portion.

* * * * *